United States Patent [19]

Uesawa et al.

[11] Patent Number: 4,762,776

[45] Date of Patent: Aug. 9, 1988

[54] SILVER HALIDE PHOTOGRAPHIC PAPER IMPROVED IN REMAINING CURL

[75] Inventors: Yutaka Uesawa, Hino; Isamu Morimoto, Hachioji, both of Japan

[73] Assignee: Konishiroku Photo Industry Co., Ltd., Tokyo, Japan

[21] Appl. No.: 74,706

[22] Filed: Jul. 17, 1987

[30] Foreign Application Priority Data

Jul. 18, 1986 [JP] Japan ..... 61-168071

[51] Int. Cl.[4] ..... G03C 1/76

[52] U.S. Cl. ..... 430/538; 430/536; 430/539; 430/635; 430/637

[58] Field of Search ..... 430/538, 635, 637, 536, 430/539

[56] References Cited

U.S. PATENT DOCUMENTS

| | | | |
|---|---|---|---|
| 2,960,404 | 11/1960 | Milton et al. | 96/94 |
| 3,536,491 | 10/1970 | Rees et al. | 96/87 |
| 3,607,290 | 9/1971 | Butler | 430/637 |
| 4,220,471 | 9/1980 | Date et al. | 430/538 |
| 4,312,937 | 1/1982 | Kasper et al. | 430/538 |
| 4,331,508 | 5/1982 | Miyama et al. | 430/538 |
| 4,558,002 | 12/1985 | Aotsuka et al. | 430/538 |
| 4,572,893 | 2/1986 | Asao et al. | 430/538 |

FOREIGN PATENT DOCUMENTS

| | | |
|---|---|---|
| 1293252 | 10/1972 | United Kingdom . |
| 1307373 | 2/1973 | United Kingdom . |

*Primary Examiner*—Jack P. Brammer

*Attorney, Agent, or Firm*—Finnegan, Henderson, Farabow, Garrett & Dunner

[57] ABSTRACT

A silver halide printing paper is disclosed, which is improved in a remaining curl. The support of the photographic paper comprises a support having a paper substratum, being coated over to the both sides thereof with a polyolefin resin, and has a Taber stiffness value of from 1.0 to 3.0 in machine direction. At least one silver halide emulsion layer is coated on one side and a hydrophilic colloidal backing layer is coated on the other side of the support. The silver halide emulsion layer contains a polyhydric alcohol in an amount of from 5 to 40% by weight to an amount by weight of the gelatin binder forming the emulsion layer and an alkyl acrylate polymer latex in an amount of from 30 to 80% by weight thereto. A total amount of gelatin coated over to the emulsion layer side of said support is not more than 4.0 g/m$^2$, and a total amount of gelatin coated over to the backing layer side of said support is not more than 2.0 g/m$^2$.

2 Claims, No Drawings

SILVER HALIDE PHOTOGRAPHIC PAPER IMPROVED IN REMAINING CURL

FIELD OF THE INVENTION

This invention relates to a silver halide photographic paper and more particularly to a silver halide photographic paper improved in remaining-curl.

BACKGROUND OF THE INVENTION

The packaging styles of silver halide photographic paper are roughly classified into two, namely, the so-called sheet paper and roll paper. In recent years, such roll paper has overwhelmingly increased its share with the advance of the automated and rapid exposures and processing of photographic paper. However, such roll paper has the problem of remaining curl that is one of its characteristic problems. The degrees of remaining curl greatly depend upon not only the external factors such as a diameter of roll, a period of time on standing, a temperature, a humidity and so forth, but also the intrinsic factors such as the characteristics of photographic paper itself.

The latter factors include, for example, a thickness or stiffness of a support used, a curling degree of the support itself, the physical properties of photographic layers coated over to the support and so forth.

Recently, paper supports coated over to the both sides thereof with polyolefin resins have become popular to used as photographic paper supports, with the advance of rapid processing techniques. The seriousness of the problem of such remaining curl in photographic paper having polyolefin-coated paper to serve as the support thereof is as same as in those having any other paper support.

The practical troubles caused from such remaining curl include, for example, a paper clogged in a color printer or a computer-aided photo type setting machine, a paper plugged in the inlet of an automatic processor, an edge or corner warp caused when pasting on a photograph mount, and so forth.

There is a system getting recently popularized, in which an exposure unit and an automatic processor are connected each other through a paper-transport unit so as to automatically process photographic paper after exposure. In such a system, a remaining curl is liable to take place a paper transport failaure because the paper transport unit is lengthy and complicated.

In the case of a photographic paper having a relatively thinner support, such as a computer-aided photo type setting paper, in particular, there very often causes a paper clogging immediately if once a paper get stuck.

Many well-known techniques for improving the remaining curl of paper supports and photographic papers themselves have so far been disclosed. They include, for example, a technique in which a polyethylene resin concentration is controlled, such as disclosed in Japanese Patent Examined Publication No. 9963/1973; a technique in which a polymer latex is added to a photographic layer, such as disclosed in Japanese Patent Examined Publication No. 43125/1973; a technique in which a wetting agent is added to a photographic layer, such as disclosed in Japanese Patent Publication Open to Public Inspection, U.S. Pat. No. 2,960,404 and so forth or a technique in which a hydrophilic colloidal backing layer is coated over.

The above-given techniques may be satisfactory to improve the curl of photographic print paper itself, but still not satisfactory to improve remaining curl at issue, particularly, there has not yet been known any technique for improving remaining curl of photographic paper having a a polyolefin resin coated paper support having a relatively low Taber stiffness value such as from 1.0 to 3.0 in machine direction and bearing thereon a hydrophilic colloidal backing layer.

SUMMARY OF THE INVENTION

It is an object of the invention to provide a silver halide photographic paper improved in remaining curl.

Another object of the invention is to provide a silver halide photographic paper which comprises a support having a paper substratum, being coated over to the both sides of the support with a polyolefin resin, having a Taber stiffness value of from 1.0 to 3.0 in machine direction and having both at least one silver halide photographic emulsion layer on one side of the support and a hydrophilic colloidal backing layer on the other side thereof.

The above-mentioned objects of the invention can be achieved with a silver halide photographic paper which comprises a support having a paper substratum, being coated over to the both sides of the support with a polyolefin resin, having a Taber stiffness value of from 1.0 to 3.0 in machine direction and having both at least one silver halide photographic emulsion layer on one side of the support and a hydrophilic colloidal backing layer on the other side thereof, wherein at least one of the above-mentioned photographic emulsion layers contains a polyhydric alcohol in an amount of 5 to 40% by weight to an amount by weight of the gelatin binders forming the above-mentioned photographic emulsion layers and an alkyl acrylate polymer latex in an amount of 30 to 80% by weight thereto and a total amount of gelatin coated over to the emulsion layer side is to be not more than 4.0 g/m$^2$ and a total amount of gelatin coated over to the backing layer side is to be not more than 2.0 g/m$^2$.

DETAILED DESCRIPTION OF THE INVENTION

The supports which are to be used in the invention are those each coated over to the both sides of the substratum thereof with a polyolefin resin.

Such a layer constitution as expressed herein that 'at least one silver halide photographic emulsion layer arranged or coated over to one side of a support' means a layer arrangement in which an emulsion layer is provided directly over to one surface of a support, or that a subbing layer is provided over to a surface of the support and emulsion layers are provided over to the subbing layer and protective layers are provided if required over to the emulsion layers respectively, or further that interlayers if required and the above-mentioned emulsion layers are repeatedly provided as required over to the emulsion layers respectively and further protective layers are provided if required over to the emulsion layers respectively.

The expression, 'a total amount of gelatin coated over to the emulsion layer side', means that an aggregate amount of the gelatin being contained in every emulsion layer and besides the other layers including, for example, subbing layers, interlayers and protective layers, each present on one surface of the support to which the silver halide emulsion layers are coated over.

The above-mentioned backing layers mean that those each coated over to the side of a support opposite to an emulsion-coated side thereof.

In this invention, at least one photographic emulsion layer contains a polyhydric alcohol and some of the typical examples of such polyhydric alcohols being applicable thereto may be given below. It is however needless to say that those polyhydric alcohols applicable to the invention shall not be limited thereto, but are those each having, in the molecules thereof, at least two OH groups each bonded to carbon atoms constituting a aliphatic chain. They also include, for example, monosaccharides, polysaccharides and so forth.

(A-1) Ethylene glycol
(A-2) Propylene glycol
(A-3) Butane diol
(A-4) Hexane diol
(A-5) Diethylene glycol
(A-6) Triethylene grycol
(A-7) Glycerol
(A-8) Diglycerol
(A-9) Pentaerythritol
(A-10) Trimethylol ethane
(A-11) Trimethylol propane
(A-12) Trimethylol isobutane
(A-13) Trimethylol hexane
(A-14) Hexose
(A-15) Maltose The above-mentioned compounds denoted by (A-1) through (A-15) may be used independently or in combination.

In the invention, such polyhydric alcohols are to be used in an amount of from 5 to 40% by weight to gelatin binders used in a photographic emulsion layer. If the amount thereof used is less than 5% by weight, a remaining curl may not satisfactorily be improved. If exceeding 40% by weight, such an adhesion trouble as an adhesion of light-sensitive materials to each other layer surfaces and the like is liable to cause in storage.

The alkyl acrylate polymer latexes which may be used in the invention include any homopolymers or copolymers having at least one kind of alkyl acrylate unit in the component units of the latexes.

The typical examples of the alkyl acrylates which can be used for preparing polymer latexes include a methyl acrylate, an ethyl acrylate, a propyl acrylate, a butyl acrylate, an amyl acrylate, a hexyl acrylate and so forth.

As for the component units of such a copolymer as mentioned above, an unsaturated monomer having an ethylene group, other than alkyl acrylates, may be used. The typical examples thereof include acrylic acid, itaconic acid, such an unsaturated carboxylic acids as methacrylic acid and so forth; α-substituted alkyl acrylates such as methyl methacrylate, butyl methacrylate and so forth; acrylamides such as butyl acrylamide and so forth; α-substituted acrylamides such as butyl methacrylamide and so forth; vinyl esters such as vinyl acetate and so forth; vinyl halides such as vinyl chloride, vinylidene chloride and so forth; styrene; α-substituted styrenes such as α-methyl styrene and so forth; ethylene; propylene; butylene; butadiene; and so forth.

Such polymer latexes may be prepared in an emulsification-polymerization process. The emulsifing agents include, for example, such an anionic surface active agent as a higher sodium alkylsulfate, a higher sodium alkylbenzenesulfonate, a sodium alkylphenylpolyethyleneglycol sulfate, a sodium alkylpolyethyleneglycol ether sulfate, a sulfosuccinate and so forth. Besides the above, a variety of a nonionic, cationic or amphoteric surface active agent may also be used for.

For preparing polymer latexes, the processes described in, for example, Japanese Patent Examined Publication Nos, 18415/1970 and 20532/1974, and so forth may be applied.

The following (B-1) through (B-10) may be given as the typical examples of the alkyl acrylate polymer latexes which may be used in this invention and it is however needless to say that the invention shall not be limited thereto.

(B-1) Homopolymer of ethyl acrylate
(B-2) Homopolymer of butyl acrylate
(B-3) Copolymer of ethyl acrylate and acrylic acid
(B-4) Copolymer of butyl acrylate and acrylic acid
(B-5) Copolymer of butyl acrylate and vinyl acetate
(B-6) Copolymer of ethyl acrylate and sulfopropyl acrylate
(B-7) Copolymer of butyl acrylate and sulfopropyl acrylate
(B-8) Copolymer of ethyl acrylate, acrylic acid and 2-acetacetoxyethyl methacrylate
(B-9) Copolymer of methyl acrylate, sodium acryloxypropane sulfonate and 2-acetacetoxyethyl methacrylate
(B-10) Copolymer of butyl acrylate and vinylidene chloride An amount of such alkyl acrylate polymer latexes used in the invention is to be from 30 to 80% by weight to the gelatin binders being contained in a photographic layer. If an amount used is less than 30% by weight, a remaining curl may not be improved satisfactorily and if exceeding 80% by weight, adhesion troubles such as an adhesion of light-sensitive materials to each other layer surface is liable to cause in storage.

In this invention, it is necessary to coat gelatin over to the emulsion layer side in an aggregate amount of not more than 4.0 g/m$^2$, preferably from 2.0 g/m$^2$ to 4.0 g/m$^2$. If exceeding 4.0 g/m$^2$, a remaining curl is seriously increased.

It is further necessary to coat gelatin over to the backing layer side in an aggregate amount of not more than 2.0 g/m$^2$, preferably from 1.0 g/m$^2$ to 2.0 g/m$^2$. If exceeding 2.0 g/m$^2$, the remaining curl is also seriously increased.

This invention is advantageous to a polyolefin resin coated paper support having a Taber stiffness within the range of from 1.0 to 3.0 in length direction. As for photographic papers, the supports having a Taber stiffness within the range of from 1.0 to 3.0 belong to the group having a relatively low stiffness. The supports having a Taber stiffness lower than 1.0 are not suitable for a high-speed paper transit through an exposure unit or an automatic processor. If exceeding 3.0 in Taber stiffness, the advantages of the invention can hardly be enjoyed, because the stiffness is too high.

A Taber stiffness expressed in this invention means a stiffness measured by making use of a Stiffness Tester manufactured by Teledyne Taber Company.

Next, the supports being used in this invention will now be described below.

In the invention, polyolefin resins applicable to the polyolefin resin coated papers include, for example, the homopolymers such as a high, medium and low density polyethylene, a polypropylene, a polybutyne, a polypentene and so forth; or copolymers comprising two or more olefins such as an ethylene-propylene copolymer; and the mixtures thereof. It is also allowed to use those each having a variety of both densities and melt indexes independently or in the form of mixture.

Into the resin layers of a polyolefin resin coated paper used in the invention, it is preferable to suitably add white pigments such as titanium dioxide, zinc oxide, tarc, calcium carbonate and so forth; and besides the above, fatty acid amides such as a stearic acid amide, an arachidic acid amide and so forth; fatty acid metallic salts such as zinc stearate, calcium stearate, magnesium stearate, calcium palmitate, and so forth; pigments and dyestuffs such as ultramarine blue, cobalt violet and so forth; and a variety of additives such as an oxidation inhibitor, an optical brightening agent, a UV absorbing agent and so forth. In particular, when the titanium dioxide is added into the resin layer of a resin coated paper and such resin layer is provided onto the side of the paper coated with a photographic emulsion layer, an amount of the titanium dioxide used is preferably within the range of from 5 to 20% by weight to the amount by weight of resins contained in the resin layer. When the ultramarine blue and a white pigment such as titanium dioxide are added in combination into a resin layer, an amount of such ultramarine blue added is within the range of, preferably, from 0.01 to 1.0% by weight to the amount by weight of resins contained in the resin layer and, more particularly, from 0.04 to 0.5% by weight thereto.

The polyolefin resin coated papers used in the invention may be prepared in such a manner that a resin composition containing a titanium dioxide pigment is fused with heating and is then extruded in the form of film with fusing from a slit die to a substratum which is ordinarily travelling so as to be coated thereover. A fusing and extruding temperature is preferably from 200° to 350° C.

Before coating the resin composition over to the paper substratum, it is preferred to apply activation treatments such as a corona-discharge, flame and other treatments to the paper substratum. There is no special limitation to a thickness of the resin layer coated over to a resin coated paper and it is, however, advatageous to extrude and coat it generally in a thickness of the order of from 5 to 50 microns. Further, in an ordinary resin coated paper coated with resins on the both sides thereof, the front side of the resin layer containing a titanium dioxide pigment may be of the glossy, matt, silk-surfaced or the like, and the back side thereof may ordinarily be of the non-glossy. It is, however, allowed to apply activation treatments such as a corona-discharge, flame or other treatment to the front side or both of the front and back sides, if required.

The paper substrata of polyolefin resin coated paper used in the embodiments of the invention may be any one of oridinary natural pulp papers or synthetic papers and, inter alia, it is advantageous to use natural pulp papers having wood pulps such as conifer pulps, broad-leaf-tree pulps or the mixtures thereof for their main materials.

There is no special limitation to the thicknesses of paper substrata. It is, however, preferable that the surfaces of the paper substrata are flat and smooth and the basis weight thereof are within the range of from 50 to 120 g/m$^2$.

In the paper substrata having natural pulps for their main materials which may advantageously be used in the embodiments of the invention, they are allowed to contain a variety of polymers and additives, in suitable combination, including, for example, dried paper strength reinforcing agents such as a cationic starch, a cationic polyacrylamide, an anionic polyacrylamide, a carboxy-denatured polyvinyl alcohol, a gelatin and so forth; sizing agents such as a fatty acid salt, a rosin derivative, a dialkylketene-dimer emulsion, a petrolium-resin emulsion, an ammonium salt of a styrene-anhydrous maleic acid copolymer alkyl ester and so forth; pigments such as clay, kaolin, calcium carbonate, barium sulfate, titanium dioxide and so forth; Wet paper strength reinforcing agents such as a melamine resin, a urea resin, an epoxidized polyamide resin and so forth; fixing agents such as polyvalent metallic salts, e.g., aluminium sulfate, aluminium chloride and so forth, cation-denatured polymers, e.g., a cationic starch and so forth; pH adjusting agents such as caustic soda, sodium carbonate, and hydrochloric acid; inorganic electrolytes such as common salt, Glauber's salt and so forth; and, besides, dyestuffs, optical brightening agents, latexes and so forth.

In the photographic print papers of the invention, each of the photographic component layers thereof are allowed to contain the binders such as those given below:

For example, Hydrophilic colloids including proteins such as a gelatin, a colloidal albumin, a casein and so forth; cellulose compounds such as carboxymethyl cellulose, hydroxyethyl cellulose and so forth; derivatives such as those of agar, sodium alginate, starch and so forth; synthesized hydrophilic colloids such as a polyvinyl alcohol, a poly-N-vinyl pyrolidone, a polyacrylic acid copolymer, a polyacrylamide or the derivatives thereof and the partially hydrolyzed matter; and so forth. If required, these colloids may be combinedly used in the form of the mixture.

Among them, gelatin is most popularly used. Such gelatins as mentioned herein mean the so-called lime-treated gelatins, acid-treated gelatins and enzyme-treated gelatins.

In the above-mentioned gelatins, a part or the whole thereof may be substituted by a synthesized polymer. Besides the above, such gelatins may be used after substituting them with the so-called gelatin derivatives which are, namely, those treated or modified with a reagent having a group capable of reacting with such a functional group being contained in the molecules of the gelatin as an amino, imino, hydroxy or carboxyl group, or the graft polymers.

The silver halide emulsions of a photographic paper used in the invention may ordinarily be prepared in such a manner that a solution of such a water-soluble silver salt as silver nitrate and a solution of such a water-soluble halogen salt as potassium bromide are mixed together in presence of such a solution of water-soluble polymers as that of gelatins. The silver halides used therein include, for example, silver chloride and silver bromide and, besides, such a mixed silver halides as silver chlorobromide, silver iodobromide, silver chloroiodobromide and so forth.

If required, such photographic emulsions as mentioned above may be spectrally sensitized or supersensitized by making use, independently or in combination, of polymethine spectral sensitizers such as cyanine, melocyanine, carbocyanine and so forth, or by making use of the above-mentioned spectral sensitizers and styryl dyes or the like in combination.

The photographic emulsions of photographic papers of the invention are allowed to contain a variety of compounds for the purposes of preventing a sensitivity lowering and fogging in the courses of manufacturing, storing or processing light-sensitive materials. There have so far been well-known compounds without number such as many heterocyclic compounds, mercury-containing compounds, mercapto compounds, metallic salts and so forth including, of course, 4-hydroxy-6-methyl-1,3,3a,7-tetrazaindene,3-methyl-benzothiazole and 1-phenyl-5-mercaptotetrazole.

In the case of applying a silver halide emulsion to a color photographic light-sensitive material, a coupler may be added into a silver halide emulsion layer. Such a coupler as may be added therein include, for example, a 4-equivalent type diketomethylene yellow coupler, a 2-equivalent type diketomethylene yellow coupler, a 4- or 2-equivalent type pyrazolone or indazolone magneta coupler, an α-naphthol or phenol cyan coupler, and so forth.

In the photographic papers of the invention, the silver halide emulsion layers and the other layers thereof may be hardened by making use, independently or in combination, of a variety of organic or inorganic hardening agents. The typical examples of such hardening agents may be given as follows:

Aldehyde compounds such as mucochloric acid, form-aldehyde, trimethylol melamine, glyoxal, 2,3-dihydroxy-1,4-dioxane, 2,3-dihydroxy-5-methyl-1,4-dioxane, succin-aldehyde and glutar-aldehyde; active vinyl compounds such as divinyl sulfone, methylene bismaleimide, 1,3,5-triacryloyl-hexahydro-s-triazine, 1,3,5-trivinyl sulfonyl-hexahydro-striazine bis(vinyl sulfonyl methyl) ether, and 1,3-bis(vinyl sulfonyl methyl)-propanol,2-bis(α-vinyl sulfonyl acetamide)-ethane; active halide compounds such as sodium 2,4-dichloro-6-hydroxy-s-triazine and 2,4-dichloro-6-methoxy-s-triazine; ethyleneimine compounds such as 2,4,6-triethyleneimino-s-triazine; and so forth.

The photographic component layers of the invention are also allowed to contain surface active agents independently or in combination. These surface active agents are used for a coating assistant and they may sometimes be applied also for the other purposes of, for example, making an emulsification-dispersion, improving sensitization or other photographic characteristics, adjusting triboelectric series and so forth.

Such surface active agents are classified into the following ones. namely, natural surface active agents such as saponin and so forth; nonionic surface active agents such as those of the alkylene oxide type, glycerol type, glycidol type and so forth; cationic surface active agents such as those of higher alkylamines, quaternary ammonium salts, heterocyclic compounds of pyridines or others, phosphoniums or sulfoniums; anionic surface active agents such as those containing such an acidic group as carboxylic acid, sulfonic acid, phosphoric acid, a sulfate, a phosphate and so forth; and amphoteric surface active agents such as those of amino acids, aminosulfonic acids, a sulfate or phosphate of aminoalcohol, and so forth.

Some examples of these surface active agents applicable thereto are described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174, 3,545,974, 3,666,478 and 3,507,660; British Pat. No. 1,198,450; Ryohei Uchida et al, 'Syntheses of Surface Active Agents and the Applications Thereof', Maki Book Store, 1964; A. W. Perry, 'Surface Active Agents', Interscience Publication, Inc., 1958; J. P. Sithley, 'Encyclopaedia of Active Agents', Vol. 2, Chemical Publishing Co., 1964; and other books.

Besides the above, in the photographic papers of the invention, a variety of photographic additives may be used, if required. For example, a UV absorbing agent, optical brightener an oxidation inhibitor, an antistaining agent, a sequestering agent, a thickening agent, a matting agent, an antihalation dye, an antiirradiation dye, and so forth.

In the case of developing a silver halide photographic paper of the invention, the developing agents used therein may be selected from various ones according to the light-sensitive materials actually prepared. The following developing agents may be given as the examples.

As for the typical developing agents of the HO—(CH=CH)$_n$—OH type, hydroquinone may be given. Besides the above, they include, for example, catechol or pyrogallol and the derivatives thereof, ascorbic acid, chlorohydroquinone, bromohydroquinone, isopropylhydroquinone, toluhydroquinone, methyl hydroquinone, 2,3-dichlorohydroquinone, 2,5-dimethylhydroquinone, 2,3-dibromohydroquinone, 2,5-dihydroxyacetophenone, 2,5-diethyl hydroquinone, 2,5-di-p-phenethyl hydroquinone, 2,5-dibenzoylaminohydroquinone, 4-chlorocatechol, 3-phenylcatechol, 4-phenyl-catechol, 3-methoxy-catechol, 4-acetyl-pyrogallol, 4-(2-hydroxybenzoyl)-pyrogallol, sodium ascorbate, and so forth.

The developing agents of the HO—(CH—CH-)$_n$—NH$_2$ type include, typically, o- and p-aminophenol or aminopyrazolone. They also include, for example, 4-aminophenol, 2-amino-6-phenylphenol, 2-amino-4-chloro-6-phenylphenol, 4-amino-2-phenylphenol, 3,4-diaminophenol, 3-methyl-4,6-diaminophenol, 2,4-diamino-resorcinol, 2,4,6-triaminophenol, N-methyl-p-aminophenol, N-β-hydroxyethyl-p-aminophenol, p-hydroxy-phenylaminoacetic acid, 2-aminonaphthol and so forth.

Further, the developing agents of the H$_2$N—(CH=CH)$_n$—NH$_2$ type include, for example, 4-amino-2-methyl-N,N-diethyl-aniline, 2,4-diamino-N,N-diethylaniline, N-(4-amino-3-methylphenyl)morpholine, p-phenylenediamine, 4-amino-N,N-dimethyl-3-hydroxyaniline, N,N,N,N-tetramethylparaphenylenediamine, 4-amino-N-ethyl-N-(β-hydroxyethyl)-aniline, 4-amino-N-ethyl-(β-methoxyethyl)-3-methyl-aniline, 4-amino-3-methyl-N-ethyl-N-(β-methyl-sulfonamidoethyl)-aniline, 4-amino-N-butyl-N-γ-sulfobutyl-aniline, 1-(4-aminophenyl)-pyrrolidine, and so forth.

The heterocyclic type developing agents include, for example, 3-pyrazolidones such as 1-phenyl-3-pyrazolidone, 1-phenyl-4,4-dimethyl-3-pyrazolidone, 1-phenyl-4-methyl-3-pyrazolidone, 1-phenyl-4-methyl-4-hydroxymethyl-3-pyrazolidone and 1-phenyl-4-methyl-4-hydroxymethyl-3-pyrazolidone, 1-phenyl-4-amino-5-pyrazolone, 1-(p-amino-phenyl)-3-amino-2-pyrazoline, 1-phenyl-3-methyl-4-amino-5-pyrazolone, 5-aminouracil and so forth.

Besides the above, there are the developing agents which are effectively useful, such as those described in, for example, T. H. James, 'The Theory of the Photographic Process', Fourth Edition, pp. 291–334 and 'Journal of the Americal Chemical Society', Vol. 73, No. 3,100, 1951.

It is also allowed to use these developing agents independently or in combination. It is, however, preferable to use them in combination. In addition, the developers each used for developing the photographic print papers of the invention are allowed to contain preservatives including, for example, sulfites such as sodium sulfite, potassium sulfite and so forth. Even if these preservatives are used therein, the effects of the invention can not be spoiled and the invention is also characterized in this point. Also, hydroxylamine and hydrazide compounds may be used therein for such preservatives. Besides the above, it is arbitrary to endow such developers with the functions of adjusting and buffering pH values with caustic alkali, alkali carbonate or alkali amine as applied to ordinary black-and-white developers. It is also arbitrary to add thereto inorganic development inhibitors such as potassium bromide and so forth; organic development inhibitors such as benzotriazole and so forth; sequestering agents such as ethylenediamine tetraacetic acid and so forth; development accelerators such as methanol, ethanol, benzyl alcohol, polyalkylene oxide and so forth; surface active agents such as sodium alkylarylsulfonate, natural saponin, sugars, the alkyl esters of the above-mentioned compounds and so forth; hardening agents such as glutaric aldehyde, formalin, glyoxal and so forth; ionic strength adjusting agents such as sodium sulfate and so forth; and the like agents.

The developers used in the invention are also allowed to contain Alkanol amines and glycols to serve as an organic solvent.

A pH value of the developers each having the above-mentioned composition is to be, preferably, from 9 to 12 and, more preferably, from 10 to 11 from the viewpoints of the preservability and the photographic characteristics.

The silver halide photographic print papers of the invention may be processed under a variety of conditions. Namely, concerning processing temperatures, a developing temperature, for example, is preferably not higher than 50° C. and more preferably within the range of from 30° to 40° C. and a particularly preferable developing time is to be not longer than two minutes, because a good effects can be enjoyed, though a development is to be completed ordinarily within 3 minutes. As for the processing steps other than a developing step, it is arbitrary to take the steps including, for example, washing, stopping, stabilizing and fixing steps and, if required, other steps such as prehardening, neutralizing and the like steps. In addition, the above-mentioned processing steps may be carried out in the so-called manual processings such as a tray, frame or other development or in the mechanical processings such as a roller, hanger or other development.

EXAMPLE

This invention will now be illustrated with reference to the following embodiment. It is, however, needless to say that the invention shall not be limited thereto.

The method of preparing a coating solution for a backing layer and the method of coating the same:

A solution for coating a backing layer was prepared in such a manner that silica having an average grain size of 3.5 μm for a matting agent in a proportion of 100 mg/m$^2$, sodium salt of 2-sulfo bis(2-ethylhexyl) succinate for a coating aid in a proportion of 50 mg/m$^2$, styrene-anhydrous maleic acid copolymer for a thickening agent in a proportion of 60 mg/m$^2$ and formalin in a proportion of 10 mg per g of the gelatin content of a backing layer to be coated were added into gelatin binders. Next, the resulted solution for coating a backing layer was coated over to the polyethylene-coated papers, X, Y and Z, provided thereon with the subbing layers having the Tabor stiffness values indicated in Table-1, respectively. The amounts of gelatin coated over to the backing layers were varied as shown also in Table-1, respectively.

The methods of preparing the coating solutions respectively for an emulsion layer and a protective layer and the methods of coating the same:

First, a coating solution for an emulsion layer was prepared in the following manner. A mostly tetradeca hedral silver halide emulsion having an average grain size of 0.6 μm was so prepared as to have the silver halide contents of silver bromide in a proportion of 90 mol %, silver chloride of 9 mol % and silver iodide of 1 mol %, respectively, and the resulted silver halide emulsion was then gold- and sulfur-sensitized.

To the resulted sensitized emulsion was added, respectively, by 4-hydroxy-6-methyl-1,3,3a,7-tetrazaindene in an amount of 1 g per mol of Ag for a stabilizer; the spectral sensitizing dyes (I) and (II) each shown below in an amount of 100 mg per mol of Ag for a spectral sensitizer; sodium tripropylnaphthalene-sulfonate in an amount of 1 g per mol of Ag for a coating aid; styrene-anhydrous maleic acid copolymer in an amount of 5 g per mol of Ag for a thickening agent; and the reaction product of tetrakis (vinylsulfonyl methyl)-methane and taulin potassium salt (1:0.25 in mol), for a hardening agent, in an amount of 30 mg per g of gelatin used; and further added by the polyhydric alcohols and the alkylacrylate latexes in the amounts shown in Table-1, respectively.

Next, a coating solution for a protective layer was prepared in such a manner that gelatin binders were added respectively by silica having an average grain size of 4.0 μm in an amount of 30 mg/m$^2$, for a matting agent; sodium salt of 2-sulfo bis(2-ethylhexyl)succinate in an amount of 30 mg/m$^2$, for a coating aid; styrene-anhydrous maleic acid copolymer in an amount of 100 mg/m$^2$, for a thickening agent; a reaction product of tetrakis(vinylsulfonyl methyl)methane and taulin potassium salt (1 : 0.25 in mol), for a hardening agent, in an amount of 30 mg per g of gelatin used.

Spectral sensitizing dye (I)

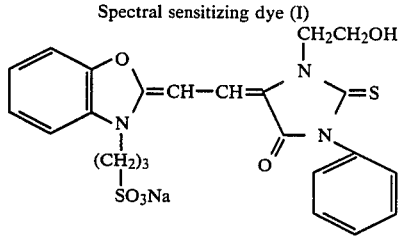

Spectral sensitizing dye (II)

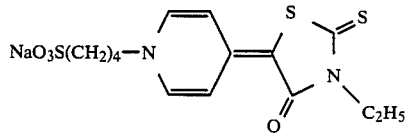

The resulted coating solutions respectively for an emulsion layer and a protective layer were superposed on to one side of each of subbing-layered polyethylene-coated papers X, Y and Z having Tabor stiffnesses of 1.5, 2.5 and 3.5, which is opposite to the side thereof provided with the backing layers. The amounts of silver coated were 1.4 g/m$^2$ and the amounts of gelatin coated were as shown in Table-1, respectively.

Evaluation of remaining curl:

The resulted sample was cut into 20 cm width by 10 m length. The sheet of the sample was wrapped round a core having an outside diameter of 3 cm, facing the emulsion side inward and was then stored for one week, one month and 4 months, under the conditions at 23° C. and 50%RH, respectively. After then, the degrees of the remaining curl of the stored samples were measured under one and the same condition. The degrees of the remaining curl were obtained in such a manner that each sample of 10 cm×10 cm in size was taken from the position one meter apart from the core and the curvature, m$^{-1}$, of the sample was measured. The results thereof are shown in Table-1.

Evaluation of adhesion resistance:

The resulted coated sample was cut into a square of 10 cm×10 cm in size and the moisture thereof was adjusted to 23° C. and 55%RH, taking 24 hours. After the emulsion side and the backing layer side were overlapped face to face, a 2 kg load was applied thereonto and they were further stored for 24 hours. Thus, the resulted adhered state was observed and evaluated. The results thereof are shown in Table-1.

In Table-1, every evaluation of the adhered state was evaluated by the following grades A to C:

A: Adhered area was not more than 10% of the whole area.

B: Adhered area was from 10% to 50% of the whole area.

C: Adhered area was not less than 50% of the whole area. (Results of the evaluation)

The results of the evaluation are shown in Table-1.

The samples of the invention, 1-6, 1-7, 1-8, 1-11, 1-12 and 1-13, each showed the degrees of remaining curl of from 12 to 15 even after they were allowed to stand for 4 months and the resulted facts apparently prove the excellence of the invention.

As described above, according to the invention, a silver halide photographic print paper improved in remaining curl can be prepared.

TABLE 1

| Sample No. | Support Kind | Support Tabor stiffness | Polyhydric alcohol Kind | Polyhydric alcohol Amt. added | Latex Kind | Latex Amt. added | Amt. Gelatin ctd. (on Em. layer side) Emulsion layer | Protective layer | Total |
|---|---|---|---|---|---|---|---|---|---|
| 1-1 | X | 1.5 | — | — | B-2 | 50% by wt. | 2.0 g/m$^2$ | 1.2 g/m$^2$ | 3.2 g/m$^2$ |
| 1-2 | " | " | A-5 | 10% by wt. | — | — | " | " | " |
| 1-3 | " | " | " | " | B-2 | 50% by wt. | 3.0 g/m$^2$ | " | 4.2 g/m$^2$ |
| 1-4 | " | " | " | " | " | " | 2.0 g/m$^2$ | 2.2 g/m$^2$ | 4.2 g/m$^2$ |
| 1-5 | " | " | " | " | " | " | " | 1.2 g/m$^2$ | 3.2 g/m$^2$ |
| 1-6 | " | " | " | " | " | " | " | " | " |
| 1-7 | " | " | " | " | " | 80% by wt. | " | " | " |
| 1-8 | " | " | A-7 | 30% by wt. | " | 50% by wt. | " | " | " |
| 1-9 | " | " | " | 50% by wt. | " | " | " | " | " |
| 1-10 | " | " | A-5 | 10% by wt. | " | 100% by wt. | " | " | " |
| 1-11 | " | " | " | " | B-3 | 30% by wt. | " | " | " |
| 1-12 | " | " | " | " | " | 50% by wt. | " | " | " |
| 1-13 | Y | 2.5 | " | " | " | " | " | " | " |
| 1-14 | Z | 3.5 | " | " | " | " | " | " | " |

| Sample No. | Amt. gelatin ctd. (on Bkg. layer side) | Degree of remaining curl 1 wk. | 1 mo. | 4 mo. | Adhesion resistance | Remark |
|---|---|---|---|---|---|---|
| 1-1 | 1.5 g/m$^2$ | 10 | 14 | 20 | A | Comp. |
| 1-2 | " | 25 | 25 | 30 | A | " |
| 1-3 | " | 15 | 20 | 22 | A | " |
| 1-4 | " | 15 | 20 | 22 | A | " |
| 1-5 | 2.5 g/m$^2$ | 15 | 20 | 22 | A | " |
| 1-6 | 1.5 g/m$^2$ | 10 | 10 | 12 | A | Inv. |
| 1-7 | " | 8 | 10 | 12 | A | " |
| 1-8 | " | 10 | 10 | 12 | A | " |
| 1-9 | " | 8 | 8 | 10 | C | Comp. |
| 1-10 | " | 8 | 8 | 8 | C | " |
| 1-11 | " | 10 | 12 | 14 | A | Inv. |
| 1-12 | " | 10 | 10 | 12 | A | " |
| 1-13 | " | 8 | 12 | 15 | A | " |
| 1-14 | " | 8 | 15 | 25 | A | Comp. |

What is claimed is:

1. A silver halide pohotographic paper comprising a support having a paper substratum, being coated over to the both sides thereof with a polyolefin resin, and having a Tabler stiffness value of from 1.0 to 3.0 in machine direction, and having both at least one silver halide emulsion layer on one side and a hydrophilic colloidal backing layer on the other side thereof, wherein said silver halide emulsion layer contains a polyhydric alcohol in an amount of from 5 to 40% by weight to an amount by weight of the gelatin binder forming said silver halide emulsion layer and an alkyl acrylate polymer latex in an amount of from 30 to 80% by weight thereto, a total amount of gelatin coated over to the emulsion layer side of said support is not more than 4.0 g/m$^2$, and a total amount of gelatin coated over to the backing layer side of said support is not more than 2.0 g/m$^2$.

2. The silver halide photographic paper of claim 1, a total amount of gelatin coated over to the emulsion layer side of said support is from 2.0 to 4.0 g/m$^2$, and a total amount of gelatin coated over to the backing layer side of said support is from 1.0 to 2.0 g/m$^2$.

* * * * *